United States Patent [19]

Kutz et al.

[11] Patent Number: 4,862,713

[45] Date of Patent: Sep. 5, 1989

[54] APPARATUS FOR SUPPLYING LIQUID TO AN ELONGATED LIQUID RESERVOIR

[75] Inventors: Johannes Kutz, Tönisvorst; Walter Keller, Willich, both of Fed. Rep. of Germany

[73] Assignee: Eduard Küsters Maschinenfabrik GmbH & Co. KG, Krefeld, Fed. Rep. of Germany

[21] Appl. No.: 255,987

[22] Filed: Oct. 11, 1988

[30] Foreign Application Priority Data

Aug. 10, 1987 [DE] Fed. Rep. of Germany ..... 37339966

[51] Int. Cl.[4] ..... D06B 3/18; B05C 3/12; B05C 11/10; B01J 4/00

[52] U.S. Cl. ..... 68/21; 68/22 B; 68/43; 68/175; 118/122; 118/410; 118/419; 118/423; 118/429; 137/561 A

[58] Field of Search ..... 118/117, 114, 129, 121, 118/126, 400, 404, 410, 414, 405, 419, 429, 423; 137/561 A; 68/21, 22 B, 43, 175

[56] References Cited

U.S. PATENT DOCUMENTS

| | | | |
|---|---|---|---|
| 312,451 | 2/1885 | Ehret | 118/429 |
| 2,197,622 | 4/1940 | Sendzimir | 118/405 |
| 3,881,445 | 5/1975 | Nothinger | 118/405 |
| 4,193,762 | 3/1980 | Namboodri | 68/175 |
| 4,202,774 | 5/1980 | Kos | 210/274 |

FOREIGN PATENT DOCUMENTS

| | | |
|---|---|---|
| 1078527 | 3/1960 | Fed. Rep. of Germany . |
| 2036520 | 2/1972 | Fed. Rep. of Germany . |
| 1381081 | 10/1964 | France . |
| 2426495 | 12/1979 | France . |

*Primary Examiner*—Willard Hoag
*Attorney, Agent, or Firm*—Kenyon & Kenyon

[57] ABSTRACT

An apparatus for supplying liquid to an elongated liquid reservoir in a uniform manner over the length of reservoir comprises a trough, extending transversely over the width of a continuous fabric web, into which a liquid is poured from above, and a feed pipe extending longitudinally along the trough. Short, identically formed, curved tubes are uniformly distributed over the length of the feed pipe and arranged to extend transversely therefrom. The liquid is supplied over the length of the liquid reservoir from the short tubes disposed at a plurality of sites along the reservoir. The cross sectional area of the feed pipe may be significantly greater than the total cross sectional of all of the curved tubes to prevent a significant pressure drop.

13 Claims, 2 Drawing Sheets

APPARATUS FOR SUPPLYING LIQUID TO AN ELONGATED LIQUID RESERVOIR

BACKGROUND OF THE INVENTION

The invention relates generally to an apparatus for supplying liquid to an elongated liquid reservoir and, more particularly, to a trough, extending transversely over the width of a continuous fabric web, into which a treatment liquid is poured from above.

Different types of such liquid reservoirs have been used in the treatment of fabric webs. The treatment liquid may be delivered to the fabric web from the liquid reservoir or the fabric web may be guided through the liquid reservoir. In one type, the liquid reservoir of a mangle comprises a textile fabric web guided through a trough. In liquid reservoirs of this type the quantity of liquid in the trough is so great that a sufficiently uniform liquid level is assured even if the supply of the liquid to the trough occurs at only one site along the trough.

However, there are instances in which the liquid reservoir is relatively small and thereby is rapidly depleted by the fabric web, if the reservoir is not continuously filled. In such cases, the level of liquid in the reservoir can become non-uniform over the width of the web if the reservoir is supplied at only one site along the width of the fabric web. A non-uniform liquid level in the reservoir often results in non-uniform treatment of the fabric web over its width. Nonuniform web treatment can occur with use of the apparatus shown in FIG. 11 of French Patent No. 13 81 081. In this patent, only a small amount of liquid is contained in the cross section of the liquid reservoir and the compensation flow in the longitudinal direction, i.e., the direction transverse to the fabric web, is hindered by the narrowness of the trough.

Hence, the problem to which the invention is directed is provision of a feed apparatus in which liquid can be supplied over the length of the liquid reservoir in order to produce the maximum possible uniformity of web treatment.

SUMMARY OF THE INVENTION

This problem is solved and the disadvantages of the prior art avoided by provision of an apparatus for supplying liquid to an elongated liquid reservoir comprising a trough, extending transversely over the width of a continuous fabric web, into which a liquid is poured from above, a plurality of identically formed channels uniformly distributed over the length of the trough with each channel having a first end and a second end terminating at a point disposed above the trough, and a common liquid source connected to the first ends of the channels.

With such an apparatus the liquid is supplied to the liquid reservoir, not just at one location, but rather at several sites that are distributed over the length of the liquid reservoir through identically formed and identically arranged channels. Thus, each channel has an identical cross sectional area and pressure.

The number of channels, and hence the number of feed sites provided, must be large enough to produce a uniform liquid supply to the fabric web. Thus, if required, the feed sites may be arranged relatively close to each other. For example, in an apparatus for the continuous treatment of a fabric web having a width of 180 cm, the channels may be provided at an equidistant spacing of 5 cm such that 37 such channels are provided over the afore-mentioned working width.

The source of the liquid for the channels may be a feed pipe extending along the length of the liquid reservoir. To ensure that no significant pressure drop takes place along the length of feed pipe and that all of the channels are uniformly supplied with liquid, the cross sectional area of the feed pipe should be at least four times the sum of the cross sectional areas of the channels.

The channels may be formed by tubes which may extend upwardly from the feed pipe to an upper apex and then downwardly therefrom. This enables cleaning to take place particularly rapidly upon changing the treatment liquid, for example, when changing dyes. During cleaning the liquid standing in the rising part of the curved tube connected to the feed pipe may flow back into the feed pipe when the supply is closed. The treatment liquid then is drained from the feed pipe and the portions of the treatment liquid standing in the downwardly bent orifice section of the curved tube are carried along. Thus, only brief rinsing is required in order to use a new treatment liquid without encountering the danger of mixing the new liquid with substantial residues of the previous treatment liquid.

In order to provide a selectively operable rinsing operation, the feed pipe may be connected at one end to a first valve through which treatment or rinse liquid is selectively introduced and at another end to a second valve selectively connected to a drain tank. During the treatment operation the second valve connectable to the drain remains closed. If cleaning of the apparatus is to take place, for example when changing treatment liquids, the first valve is switched from a position connected to the treatment liquid supply to a position connected to the supply of rinsing liquid and the second valve is opened to the drain tank. By introducing rinsing liquid the treatment liquid standing in the feed pipe is pushed out and in the process the residue liquid standing in the curved tubes also is suctioned off. After the main quantity of the previous treatment liquid has been removed in this manner the second valve connectable to the drain is closed again whereby the apparatus can be positively flushed out.

A pivotable guide surface may be arranged below the orifices of the channels to selectively guide liquid from the channels to the trough or to a collector.

An overall particularly advantageous arrangement results from the combination of the feed apparatus of the invention and the application apparatus disclosed in French Patent No. 13 81 081 in which the trough is formed with opposing upright walls connected at their ends and closed off at the bottom of the trough by a rolling gap structure. The feed apparatus of the invention may be provided on both sides of the fabric web. In this case the first valve is connected to one set of adjacent ends of the feed pipes while the second valve is connected to the other set of adjacent feed pipe ends. This arrangement permits rapidly changing the treatment liquid and, along with provision of at least two parallel feed pipes with channels, enables application of patterns to the web.

In this manner, rapid change from one dye to the next is possible to generate in the longitudinal direction of the fabric web, relatively sharply defined color fields. It is also possible to obtain a mixing effect with this arrangement by simultaneously introducing several liquids into the trough via the feed pipes.

The above-mentioned patterning concept goes beyond the known arrangement in which a feed pipe is arranged on each side of the fabric web. With the feed arrangement of the invention not only is liquid supplied uniformly to the fabric web from both sides, but it is possible to provide at least two feed pipes on both sides of the trough. This allows for more varied patterning possibilities since patterning is not limited to one dye bath.

DETAILED DESCRIPTION

Figure 1:
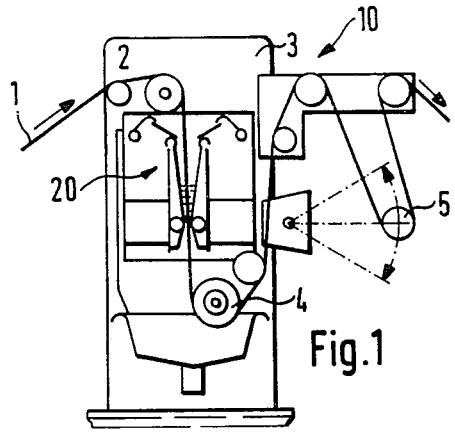
FIG. 1 shows a side view of a treatment liquid application apparatus in which a liquid feed apparatus constructed according to the principles of the invention is employed.

The treatment liquid application apparatus 10 illustrated in FIG. 1 is intended for the treatment of a textile fabric web 1 that may comprise a flat woven textile having, for example, a 1.8 m width. The fabric web 1 is led over an upper deflection roller 2 in a chassis 3 and guided therefrom vertically downward to a lower driven deflection roller 4 where it is led in the manner indicated via additional deflection rollers and a compensating roller 5, which functions to control the web speed.

Between the deflection rollers 2 and 4 the fabric web passes through an applicator 20. Parts of the applicator are reproduced in an enlarged scale in FIG. 2.

Figure 2:
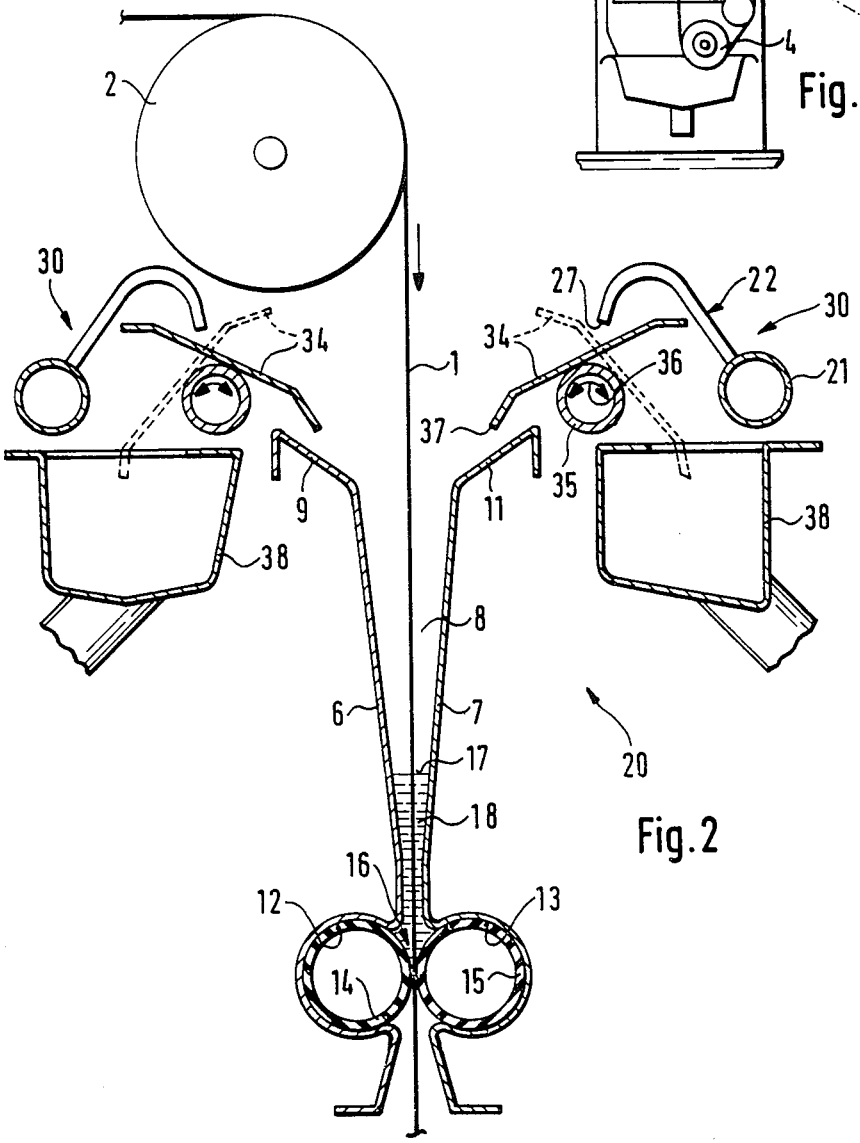
FIG. 2 shows a cross sectional view of parts of the feed apparatus of the invention illustrated in an enlarged scale from that shown in FIG. 1.

The applicator 20 comprises two bent, mutually opposing, sheets 6 and 7 arranged on both sides of the fabric web 1. Sheets 6 and 7 extend over the width of fabric web 1 and are connected to each other at their ends beyond the edges of the fabric web 1 to form a closed trough 8. The spacing between the sheets 6 and 7 decreases in the machine direction of fabric web 1, i.e., in the direction in which the web is fed, such that the trough 8 has a wedge-shaped cross section in the longitudinal plane perpendicular to the fabric web 1 as shown in FIG. 2.

The upper edges 9 and 11 of sheets 6 and 7 are bent at an angle to form drain surfaces which are inclined with respect to the interior of trough 8.

At the lower edges of the sheets, corresponding deformations form recesses 12 and 13 that oppose each other with their open sides facing inwardly. Recesses 12 and 13 extend over the width of fabric web 1. Within recesses 12 and 13, hoses 14 and 15 are arranged to be inflated with compressed air such that the hoses are adjacent to each other. The fabric web 1 is fed through gap 16 between hoses 14 and 15. Hoses 14 and 15 seal the bottom of trough 8 by abutting against both sides of the web in the region of the width of fabric web 1 and abutting against each other outside the width of fabric web 1.

Trough 8 is filled up to a predetermined level 17 with a treatment liquid 18, for example, a dyeing liquid. The fabric web 1 passes downwardly from above through the treatment liquid 18, where it absorbs liquid. Excess liquid taken-up is returned to the trough as the web is squeezed between hoses 14 and 15 to ensure a uniform moisture content.

Since sheets 6 and 7 are closely adjacent to each other, particularly in the lower region of trough 8, the quantity of treatment liquid 18 in trough 8 is low and, hence, only sufficient to treat a few meters of the fabric web 1. Without a continuous supply of treatment liquid 18 , the trough 8 would be emptied in short time.

The amount of take-up of treatment liquid by the fabric web 1 depends on the filling level 17. The filling level 17 should be uniform over the width of fabric web 1. Otherwise the treatment over the Width of the fabric web 1 will be non-uniform since the take-up will vary over the web width. In order to avoid the non-uniform application of liquid, variations in the filling level 17 of the treatment liquid must be prevented by uniformly supplying liquid over the width of fabric web 1.

Figure 3:
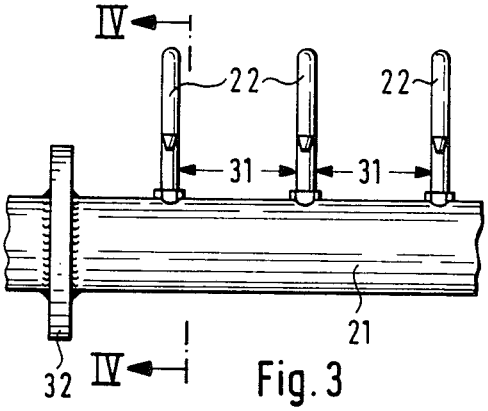
FIG. 3 shows a side view of a portion of a feed pipe constructed according to the invention.
Figure 4:
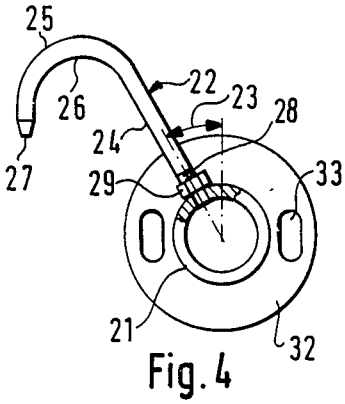
FIG. 4 shows a cross sectional view taken along line IV—IV of FIG. 3.

This is accomplished by provision of the feed arrangement 30 which may be provided on both sides of fabric web 1. The feed arrangement 30 comprises a feed pipe 21 extending parallel to the transverse width of the fabric web. Extending from feed pipe 21 are identically shaped curved tubes 22 that are spaced at equal distances along the length of the feed pipe 21 . Tubes 22 are shown in detail in FIGS. 3 and 4. The feed pipes 21 are arranged outside and above the bent edges 9 and 11 of trough 8. The curved tubes 22 are formed from a straight lower portion 24 extending radially from the top side of the feed pipe at an angle 23 with trough 8 that may be, for example, approximately 30°. The straight parts 24 of the curved tubes are connected to an upper arc portion 25 such that an apex 26 is formed. After apex 26, curved tubes 22 bend downwardly and terminate at a distance below the apex 26 in an open orifice 27 which lies above the top of the feed pipe 21. The curved tubes 22 are formed with threads 28 at their lower end to facilitate attachment to feed pipe 21 by screwing into a threaded bore of the feed pipe 21. Tubes 22 may be secured with a locking nut 29.

All of the curved tubes 22 are identically formed and arranged. The distances 31 at which they are spaced along the feed pipe 21 may be, for example, 5 cm such that for a fabric web having a width of 180 cm 37 curved tubes 22 are provided. The feed pipe 21 has flanges 32 at its ends for fastening on a chassis and its orientation about its longitudinal axis can be adjusted via oblong holes 33.

As shown in FIG. 2 , below orifices 27 of the curved tubules 22, guide surfaces 34 are provided that extend along the width of fabric web 1. Surfaces 34 are in the form of sheets bent at their longitudinal edges. Guide surfaces 34 are fastened on a support tube 35, which can be pivoted about its longitudinal axis by a predetermined angle, such as 80°, in the direction of arrow 36.

In a first limit position, shown in solid lines in FIG. 2, the guide surface 34 is inclined in the direction toward trough 8 and the lower edge 37 of the guide surface 34 is disposed above the bent edges 9 or 11 of trough 8. In this position, treatment or rinsing liquid supplied through the feed pipe 21 flows through orifices 27 onto the guide surface 34 and downwardly from lower edge 37 in a veil that is largely uniform over the width of the fabric web 1. The veil of liquid flows onto bent edges 9 and 11 at an angle such that, due to the slope along sheets 6 and 7, approximately laminar flow into the liquid reservoir 18 in the lower region of trough 8 is achieved. No spattering of the liquid occurs, nor does any liquid flow in the direction transverse to the fabric web 1.

In the second limit position of guide surface 34, shown in dashed lines in FIG. 2, the liquid leaving the curved tubes 22 is deflected into a collector 38 and, hence, does not reach trough 8.

Figure 5:
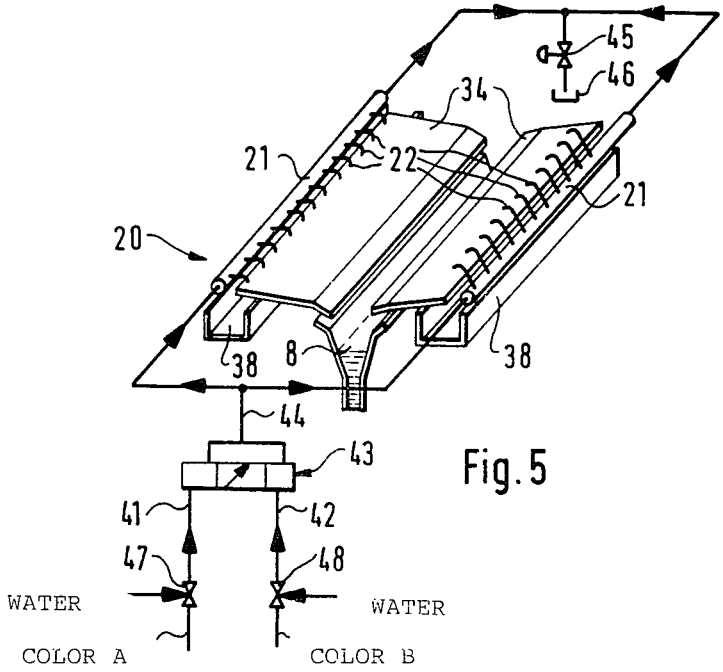
FIG. 5 schematically shows a perspective representation of the feed apparatus of the invention in which the flow path of the liquid through the feed apparatus is illustrated.

In FIG. 5 one configuration of a liquid supply circuit is shown schematically. Two feed pipes 21 are supplied in parallel with liquid from a common line 44 which is connected to the adjacent ends of the feed pipes 21 on one side of the application arrangement 20. The line 44 leads to a valve 43 which also is connected to inlet lines 41 and 42. Valve 43 has three selective positions: in the first position line 41 is connected with line 44; in the second position line 41 as well as line 42 are blocked; and in the third position line 42 is connected with line 44.

In lines 41 and 42 are located valves 47 or 48 through which a rinsing liquid, such as water, or a treatment liquid, such as dye A or a dye B, is selectively supplied to lines 41 and 42. With this arrangement diverse variations of liquid supply to feed pipes 21 is possible. Dye A can be supplied via lines 41 and 44 or, optionally, dye B via lines 42 and 44. In this manner, an immediate dye change can be achieved. In addition, by allowing water to flow into lines 41 and/or 42 via valves 47 and 48, rinsing can take place, if desired. In the rinsing process blocking valve 45 may be opened such that the water forces the treatment liquid still present in the system into drain tank 46. However, it also is possible to divert the rinse water/treatment liquid into the collector 38 by pivoting the guide surfaces 34 into the position shown in dashed lines in FIG. 2.

The ratio of the cross sectional areas of the feed pipe 21 and the curved tubes 22 is important to avoid a significant pressure drop in the feed pipes 21 to ensure uniform flow. In one particularly advantageous embodiment, the curved tubes may have an inner diameter of 2 mm and, consequently, an inner cross sectional area of 3.14 mm. If 37 such curved tubes 22 are provided, as in the example previously discussed, a total cross sectional area of approximately 116 $m^2$ is produced. The feed pipe 21 may have an inner diameter of 30.5 mm and, hence, an inner cross sectional area of 730 $mm^2$. The total cross sectional area of all the curved tubes 22 (116 $mm^2$) is, thus, only 15.8%, or, less than one sixth of the cross sectional area of the feed pipe 21 (730 $mm^2$). A difference in cross sectional areas of this magnitude ensures that no significant pressure drop occurs in the feed pipes 21.

What is claimed is:

1. Apparatus for supplying liquid to an elongated liquid reservoir comprising:

(a) a trough, extending transversely over the width of a continuous fabric web, into which a liquid is poured from above;

(b) a plurality of identically formed channels uniformly distributed over the length of the trough with each channel having a first end and a second end terminating at a point disposed above the trough; and (c) a common liquid source connected to the first ends of said channels.

2. Apparatus according to claim 1 wherein said common liquid source comprises a feed pipe having a uniform cross sectional area extending along the length of the trough.

3. Apparatus according to claim 2 wherein the cross sectional area of the feed pipe is at least four times the sum of the cross sectional area of the channels.

4. Apparatus according to claim 1 wherein said channels are formed by identical tubes extending transversely from the feed pipe and equidistantly spaced along the length of the trough.

5. Apparatus according to claim 4 wherein said tubes are curved to extend upwardly from the feed pipe to an upper apex and then downwardly therefrom.

6. Apparatus according to claim 2 further comprising a first valve connected to one end of the feed pipe through which a treatment liquid or a rinsing liquid is selectively introduced and a second valve connected to another end of the feed pipe and to a drain tank.

7. Apparatus according to claim 1 further comprising an orifice provided at the second end of each channel and a guide surface disposed below the orifices arranged to pivot from a first position permitting liquid to flow into the trough to a second position permitting liquid to flow into a collector extending parallel to the trough, said guide surface being pivotable about an axis parallel to the longitudinal axis of the feed pipe.

8. Apparatus according to claim 1 wherein the trough is formed with opposing upright walls connected at their ends and closed off at the bottom of the trough by at least one elastic areal structure inflatable against a counter surface to form a seal, with the areal structure and the counter surface forming a gap in the trough through which the fabric web may be passed vertically.

9. Apparatus according to claim 8 wherein the areal structure and the counter surface are formed by opposed inflatable hoses disposed at approximately the same height.

10. Apparatus according to claim 8 wherein a feed pipe having curved tubes extending along the length of the trough is provided at both sides of the fabric web.

11. Apparatus according to claim 10 wherein first adjacent ends of the feed pipes are connected to a first valve through which a treatment liquid or a rinsing liquid is selectively introduced and second adjacent ends of the feed pipes are connected to a second valve that is connected to a drain tank.

12. Apparatus according to claim 1 wherein said common liquid source comprises at least two parallel feed pipes provided with identically formed channels.

13. Apparatus according to claim 12 wherein at least three parallel feed pipes are provided with at least two feed pipes disposed on the same side of the fabric web.

* * * * *